United States Patent [19]

Rein, Jr.

[11] Patent Number: 4,797,660

[45] Date of Patent: Jan. 10, 1989

[54] PHOTOELECTRIC ICE ACCUMULATION MONITOR USING DUAL DETECTORS

[76] Inventor: Robert G. Rein, Jr., 3106 128th N.E., Bellevue, Wash. 98005

[21] Appl. No.: 21,343

[22] Filed: Mar. 3, 1987

[51] Int. Cl.[4] ..... G08B 21/00

[52] U.S. Cl. ..... 340/583; 244/134 F

[58] Field of Search ..... 340/583, 580; 244/134 F

[56] References Cited

U.S. PATENT DOCUMENTS 2,359,787 10/1944 Peters et al. ..... 340/583

3,540,025 11/1970 Levin et al. ..... 340/583

*Primary Examiner*—Glen R. Swann, III

*Attorney, Agent, or Firm*—Roy E. Mattern, Jr.

[57] ABSTRACT

Apparatus and method using internal reflection of electromagnetic radiation to detect ice or water on pavements or other surfaces and to continuously measure the thickness of the accumulation. A prism which is transparent to pulses of electromagnetic radiation from an emitter is mounted in the pavement with an exposed prism surface flush with, and in the plane of the surface being monitored for the accumulation. Radiation from an emitter is directed at the exposed prism surface at an angle so that the radiation is totally reflected when the exposed surface is bare, but only partially reflected when there is an accumulation. Radiation detectors are positioned so that changes in the intensity of internally-reflected radiation are measured and interpreted to detect the onset of an accumulation, measure the thickness of the accumulation, distinguish accumulations of ice from accumulations of water, and distinguish accumulations of mud or dirt from accumulations of ice or water.

30 Claims, 9 Drawing Sheets

$\phi_c$, ICE COVERED $> \theta > \phi_c$, BARE

FIG. 1
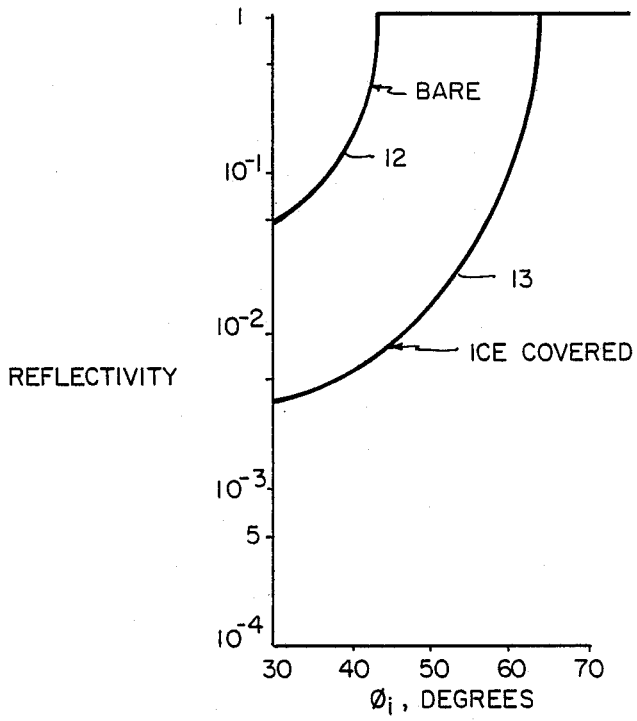
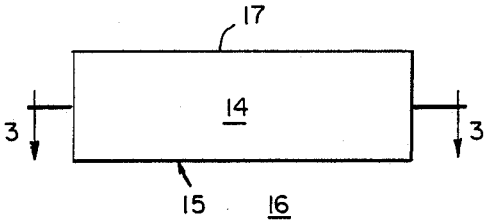
FIG. 2
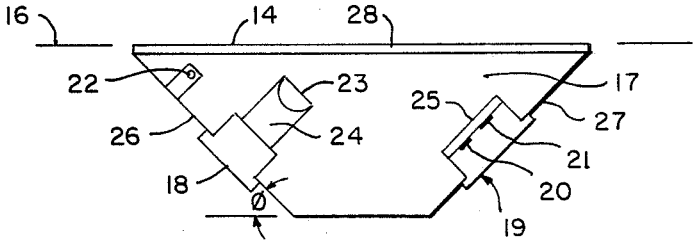
$\phi_c$, ICE COVERED $> \theta > \phi_c$, BARE
FIG. 3

FIG. 6
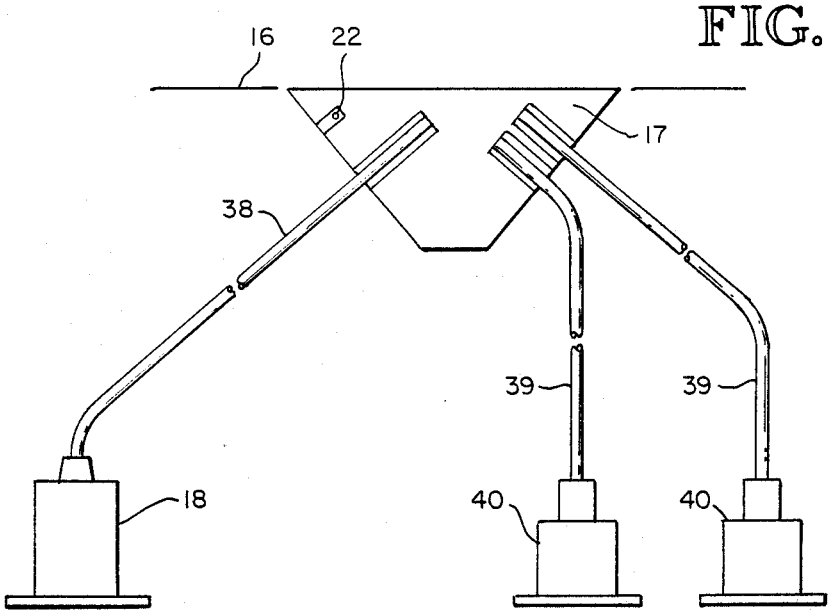
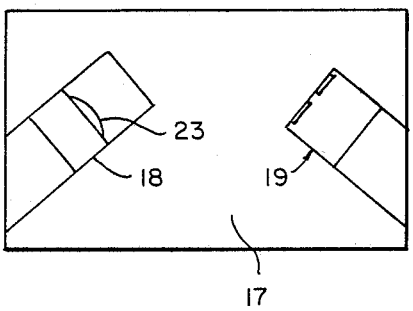
FIG. 7A
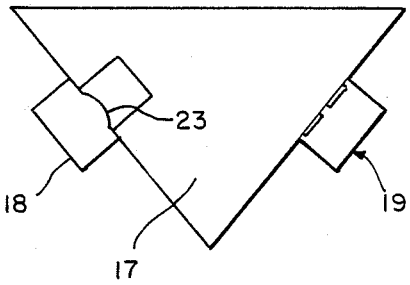
FIG. 7B

PHOTOELECTRIC ICE ACCUMULATION MONITOR USING DUAL DETECTORS

BACKGROUND OF THE INVENTION

There are many places where installation of ice accumulation monitors could be advantageous. By way of example:

At airports, operations personnel could use information from ice accumulation monitors to alert them to unsafe operating conditions caused by ice accumulation on runways;

On highways, information from ice accumulation monitors could actuate signs to alert motorists of dangerous icings, and information from ice accumulation monitors could inform highway department personnel as to where the highways need sanding, salting, and/or ice removal;

On buildings, ice accumulation on roofs could be monitored to indicate when ice removal was needed;

On aircraft wings and other aircraft surfaces, ice accumulation monitors would provide information to warn aircraft operators of unsafe ice buildups; and On radomes, ice accumulation monitors would activate deicing equipment when ice accumulation is great enough to interfere with reliable operation of the enclosed antennas, or warn personnel when deicing was necessary.

In reference to previously disclosed equipment used to measure ice accumulations, there has been:

Equipment for measuring ice accumulation by analyzing changes in frequency of an oscillating element as ice accumulates on the element. The element generally protrudes from a surface, so the element is susceptible to traffic damage when installed in a roadway. Also because the element protrudes from the surface being monitored, icing conditions on the element may differ from icing conditions on the surface. In another embodiment of such an oscillating element, a protective cap, flat for roadways, accumulates dirt so that this element is not reliable because it does not distinguish between dirt accumulation and ice accumulation;

Equipment for measuring ice accumulation by analyzing changes in the obstruction of light by the formation of ice, with the light channel portions protruding above the surface and thereby being subject to damage by traffic and inaccuracies associated with protruding elements;

Equipment for measuring ice accumulation by analyzing changes in the pressure drop across an orifice, being caused by the formation of ice, with orifice portions protruding above the surface and thereby being subject to damage by traffic and to inaccuracies associated with protruding elements;

Equipment using internal reflections to detect ice formation on a surface, as set forth in U.S. Pat. No. 2,359,787. However, this equipment does not measure the amount of ice accumulated, and does not indicate methods for compensating for interferences from changes in ambient light or for distinguishing the presence of dirt or mud; and Equipment using internal reflections to detect ice formation on a surface, as set forth in U.S. Pat. No. 3,540,025. However, this equipment uses a series of heating steps followed by removal of the melted ice, to indicate ice formation. Because these melting steps interfere with ice accumulations, continuous measurements of ice accumulation are not practical with this equipment.

The prior equipment is believed not to have been adequate in measuring accumulations of ice and especially inadequate for measuring the continuous accumulation of cracked or otherwise flawed ice.

SUMMARY OF THE INVENTION

This ice accumulation monitor adequately measures the accumulation of ice, including accumulations of cracked, or otherwise flawed ice, as it occurs on any surface, such as roadways, airport runways, sidewalks, radomes, aircraft surfaces, and the roofs of buildings. The ice accumulation monitor includes a prism which is transparent to radiation emitted by an emitter, which prism has one surface exposed to ice accumulation, this surface being flush with, and continuously in the same plane as, the surface being monitored; an emitter of pulsed electromagnetic radiation oriented so that at the exposed prism surface the emitted radiation is totally reflected within the prism when the exposed surface is bare, but the emitted radiation is only partially reflected within the prism when ice covers the exposed prism surface; and two radiation detectors to measure the intensities of the reflected radiation, and located with one detector closer to the exposed surface than the other detector. A temperature sensor, located in the prism near the exposed surface, is used to aid in distinguishing accumulations of ice from accumulations of water. Preferably the exposed surface of the prism is also a surface of a very hard transparent layer that will not be scratched or otherwise damaged by traffic or other abusive elements. To avoid nonlinear detector responses at the relatively high radiation levels that can result from some ambient lighting conditions, a bandpass filter, with its bandpass wavelength centered near the dominant wavelength emitted by the emitter, is located at a position in the prism that causes the amount of ambient radiation reaching the detectors to be reduced. The effect of ambient radiation is then eliminated from the ice accumulation measurements by subtracting the radiation detector responses when the emitter is in the off portion of its cycle from the radiation detector responses when the emitter is in the on portion of its cycle.

When ice is not present on the exposed surface of the prism, the emitted radiation is completely reflected back into the prism at the exposed prism surface and detected by the radiation detectors. The relative positions of the detectors is such that the intensity of radiation detected by one detector is greater than detected by the other detector. When ice starts to accumulate, some of the emitted radiation is transmitted into the ice, thereby reducing the amount of radiation reflected at the exposed surface. This reduction in radiation reflected at the exposed surface, combined with the different path to the detectors by radiation reflected at the ice-air interface, changes the radiation intensities detected by each detector. Through calibration, these changed intensities are related to the amount of ice accumulated. By this method, accumulations of cracked, or otherwise flawed, ice, as well as accumulations of perfect ice can be detected and measured.

In calibrating this ice accumulation monitor, the dominant wavelength of the emitted radiation is selected so that the index of refraction of ice at this wavelength is practically the same as the index of refraction of water at this wavelength, thereby allowing accumulations of water to be used to determine a calibration curve for each radiation detector. Additional calibrations are undertaken so the measured intensities of the reflected radiation will indicate when the exposed surface of the prism is covered with dirt or mud and needs cleaning.

As so arranged, installed, and used, this ice accumulation monitor adequately measures the accumulation of ice in all of its formations. If dirt or mud appear, their presence is detected, so they may be removed and the measurements can be resumed. The measurements may be transmitted to central observing instruments, to nearby signs, and to other places to warn interested observers of the amount of ice accumulated on the monitored surface.

BRIEF DESCRIPTION OF THE DRAWINGS

The ice accumulation monitor is shown, in reference to a preferred embodiment, in the drawings, wherein:

FIG. 1 shows the reflectivity of bare, and ice-covered, fused quartz interfaces for unpolarized radiation originating in the fused quartz;

FIG. 2 is a view of the ice accumulation monitor in the plane of a surface that is being monitored for ice accumulation;

FIG. 3 is a schematic section view of the ice accumulation monitor positioned with the exposed surface of its transparent prism flush with, and continuous with, the surface being monitored for ice accumulation, and indicating the location of an emitter of pulsed electromagnetic radiation, the locations of two radiation detectors, the location of a lens for collimating radiation from the emitter, the location of a bandpass filter positioned to reduce the amount of ambient radiation reaching the radiation detectors, and a location for a temperature sensor;

FIG. 6 is a schematic section view, showing an optical fiber for transmitting emitted radiation from a remote emitter to the prism, and showing optical fibers for transmitting internally reflected radiation to remote detectors;

FIG. 7A shows an alternative, rectangular prism cross section, with the emitter and detector located within the prism;

FIG. 7B shows an alternative, triangular prism cross section, with the emitter and detector located on prism surfaces;

DESCRIPTION OF THE PREFERRED EMBODIMENT OF THE INVENTION

Figure 4:
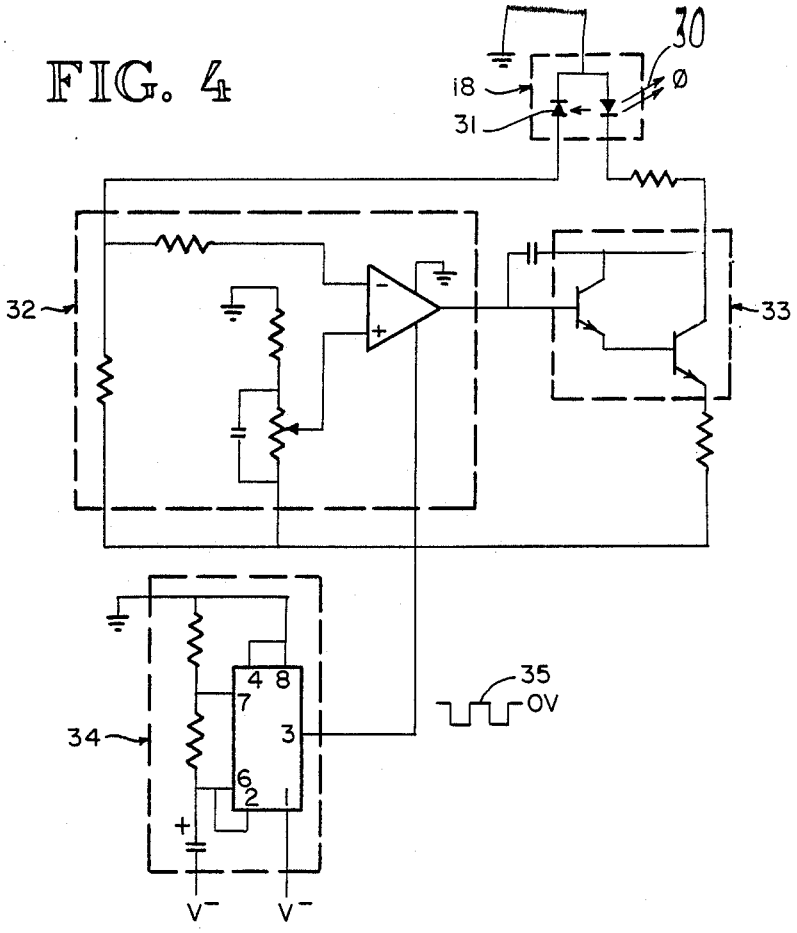
FIG. 4 is a schematic diagram of an emitter drive/-control circuit for temperature-independent pulsed emission from a laser diode/photodiode package.

To provide a background for understanding the equipment and operation described, optics concepts that relate to this ice accumulation monitor are described first, then the equipment and its operation are described.

When a light wave (electromagnetic radiation) is incident at an interface between two transparent materials with different indexes of refraction, the wave splits into two waves; a transmitted wave which proceeds into the second material, and a reflected wave which is propagated back into the first material. Snell's Law relates the orientation of the radiation that is transmitted into the second material to the orientation of the incident radiation.

The proportion of the incident energy that is reflected at the interface is characterized by the reflectivity (the energy associated with the reflected wave divided by the energy associated with the incident wave) which can be calculated from Fresnel's formulas, and which depends on the angle of incidence, $\phi_i$, (the angle that the incident wave makes with the normal to the interface), and which also depends on the ratio of the indexes of refraction of the materials on either side of the interface. A reflectivity of one indicates total reflection.

FIG. 1 shows the reflectivity of bare 12 and ice-covered 13 fused quartz interfaces for unpolarized radiation originating in the fused quartz. For incident angles greater than a critical angle, $\phi_c$, described by $$\phi_c = \sin^{-1}(n_2/n_1) : n_2 < n_1 \quad (1)$$

where $n_1$ is the index of refraction of the material in which the radiation originates and $n_2$ is the index of refraction of the material on the other side of the interface, the reflectivity is one and the incident radiation is totally reflected. For incident angles less than the critical angle, the reflectivity is less than one, so some radiation is transmitted across the interface into the material on the other side of the interface. The critical angle for bare fused quartz is 43°, and for ice-covered fused quartz, the critical angle is 64°. Therefore, when ice covers a fused quartz surface and radiation is incident at the interface at an angle less than 64°, only part of the incident radiation will be reflected; the balance will be transmitted into the ice. In addition, Snell's Law, combined with Equation 1, shows that the radiation that is transmitted into the ice will be totally reflected at the subsequent ice-air interface if the radiation incident at the fused quartz interface is incident at an angle greater than the critical angle for the bare fused quartz interface (43°), and the fused quartz-air and ice-air interfaces are parallel. Therefore, radiation that is incident at an ice-covered fused quartz interface at incident angles between 43° and 64° will be partially reflected at the interface and partially transmitted into the ice, with that part that is transmitted into the ice being totally reflected at the subsequent ice-air interface.

In FIG. 2, the exposed surface 14 of the prism 17 of an ice accumulation monitor 15 that uses these optics concepts is shown surrounded by a surface 16 that is to be monitored for ice accumulation. FIG. 3 shows a cross section of the prism 17 with a radiation emitter 18, and a detector 19 comprised of separate radiation detectors 20 and 21, arranged to use these optics concepts to measure ice accumulation on the surface 16.

THE EMITTER

In the preferred embodiment, the emitter 18 is a commercially available laser diode/photodiode package in which the photodiode monitors the emission intensity of the laser diode, so that output from the photodiode can be used as feedback in an electronic circuit to maintain the laser diode emission intensity constant regardless of temperature. Emitter operation is also pulsed, so that the effects of changes in ambient radiation can be eliminated from ice accumulation monitor operation. By way of example, FIG. 4 shows a method for electronically controlling the emitter 18 to obtain temperature-independent emission intensity 30, and to obtain pulsed operation. Output from the photodiode 31 in the laser diode/photodiode package is used as feedback to control an operational amplifier circuit 32, which supplies the laser diode drive current. Pulsed emitter operation is obtained by using a pulse generator circuit 34, based on a timer integrated circuit, to provide a square wave input 35 to the operational amplifier circuit 32 and to the amplifier section 33.

Figure 5:
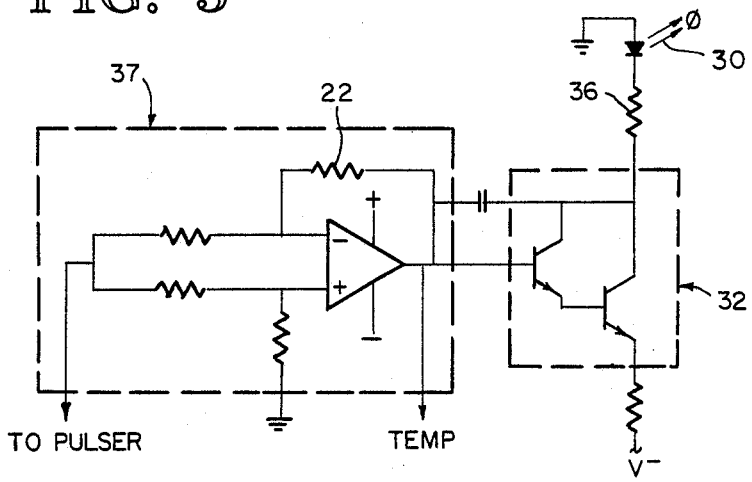
FIG. 5 is a schematic diagram of an emitter drive/-control circuit that uses a thermistor as a control element to obtain temperature-independent pulsed emission from an emitter that does not have an integral means for monitoring emission intensity.

Alternatively, an emitter such as a laser diode or a light emitting diode (LED) that does not contain an integral emission monitor can be used with feedback from a temperature sensor 22 to obtain temperature-independent emission. Temperature sensors usable for this purpose include thermocouples, resistance temperature detectors (RTDs), solid state temperature devices, and thermistors. By way of example, FIG. 5 shows a method for electronically controlling operation of a LED emitter 36 to obtain a constant emission intensity 30 regardless of temperature and to obtain pulsed emissions. An operational amplifier circuit 37 drives an amplifier section 32, which supplies the LED drive current. Temperature dependent feedback to the operational amplifier is provided by a thermistor 22 so that the output of the operational amplifier changes to offset changes in emission intensity that would result from temperature changes. Output from the operational amplifier is proportional to the thermistor resistance, which is proportional to temperature, so measurement of the operational amplifier output voltage, TEMP, also provides a means for measuring the temperature, which will be used in distinguishing ice accumulations from accumulations of water.

Figure 8:
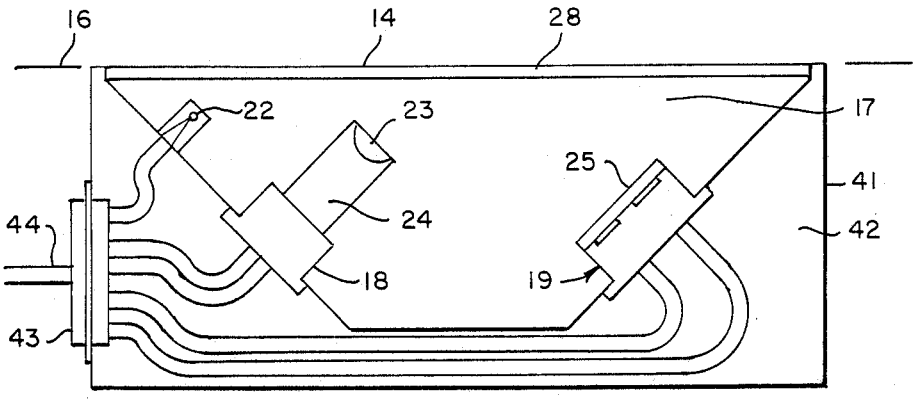
FIG. 8 is a schematic sectional view, similar to FIG. 3, but showing electrical connections to a cable connector, and the prism in a container and cushioned by an elastic material.
Figure 10:
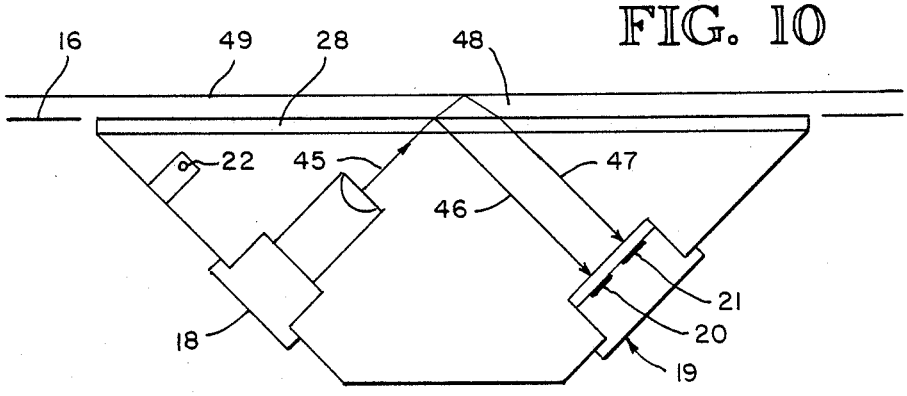
FIG. 10 is a schematic sectional view, similar to FIG. 3, but showing an accumulation of ice on the surface being monitored and on the exposed surface of the transparent prism, and showing a path for emitted radiation that is reflected from the exposed surface of the prism and a path for emitted radiation that is reflected from the ice-air interface of the accumulated ice.

As shown in FIGS. 3, 8, and 10, the emitter 18 is mounted within the prism 17 and oriented so that when the emitted radiation reaches the exposed surface 14, it is incident at an angle greater than the critical angle for a bare exposed surface, $\phi_{c,bare}$, but less than the critical angle for an ice-covered exposed surface, $\phi_{c,ice\text{-}covered}$.

Alternatively this ice accumulation monitor will operate effectively with the emitter mounted on the sloping prism surface 26 and the emitted radiation directed at the exposed surface 14 so that the radiation is incident at the exposed surface 14 at an angle greater than $\phi_{c,bare}$ but less than $\phi_{c,ice\text{-}covered}$, or this ice accumulation monitor will also operate effectively with the emitter 18 exterior to the prism and the emitted radiation transmitted to the prism, and directed at the exposed surface at an incident angle greater than $\phi_{c,bare}$ but less than $\phi_{c,ice\text{-}covered}$ by an optical fiber 38, as shown in FIG. 6. Therefore it is understood that the effectiveness of this ice accumulation monitor is not limited to emitter placements within the prism.

In addition, this ice accumulation monitor 15 will also operate as described hereafter under Ice Accumulation Monitor Operation if the emitter is oriented to produce less than total reflection at the bare exposed surface. However, in this situation, reflection at the ice-air interface is less than total and operation is less effective, so emitter orientation producing total reflection at the bare exposed surface is preferred.

A lens 23 is located in a cylindrical cavity 24, which abuts the emitter 18, to be effective in collimating the radiation from the emitter. Some emitters have integral collimating optics so a separate collimating lens 23 would not be required for these emitters. However, radiation emitted by many emitters is not sufficiently collimated to provide effective operation of the ice accumulation monitor, so the collimating lens is indicated in this preferred embodiment.

THE PRISM

The prism 17 is transparent to radiation emitted by the emitter 18 and in the preferred embodiment the prism section 3—3 has a trapezoidal shape as shown in FIG. 3. However, as long as the orientation of the emitted radiation with respect to the exposed surface 14 is such that significant reflection occurs at both the bare exposed surface and at the ice-air interface of an ice-covered exposed surface, this ice accumulation monitor will operate effectively with prisms having other cross sectional shapes, such as the rectangular shape shown in FIG. 7A and the triangular shape shown in FIG. 7B. Therefore it is understood that the effectiveness of this ice accumulation monitor is not limited to prisms having the trapezoidal shape such as shown in FIG. 3.

In the preferred embodiment the prism is made of fused quartz, but this ice accumulation monitor will also operate effectively with a prism made from any other optical quality material which is transparent to radiation from the emitter and has an index of refraction greater than the index of refraction of ice. One embodiment of the preferred emitter emits at 820 nm. For this emitter, such other materials include most optical glasses, sapphire, and ruby.

The longer 14 of the two parallel surfaces of the prism is exposed to ice accumulation, and is arranged flush with the surface 16 which is to be monitored for ice accumulation. Because scratches on the exposed surface 14 interfere with effective operation of this ice accumulation monitor, it is preferable that the exposed surface 14 also be the exposed surface of a hard transparent layer 28, as shown in FIGS. 3, 8, and 10, which will not be scratched or otherwise damaged by traffic or other abusive elements, and which also has an index of refraction greater than the index of refraction of ice. Suitable materials for the hard transparent layer include sapphire and ruby. In addition, the operation of the ice accumulation monitor 15, is not changed if the entire prism 17 is made from the hard material, used preferably as the hard transparent layer 28. However, because the hard materials are typically more expensive than the prism material and are usually more difficult to machine, limiting the hard material to a layer is preferable to making the entire prism from the hard material.

To further protect against exposed-surface damage in applications such as roadways and runways, as shown in FIG. 8, the entire prism 17 may be mounted in a container 41 and cushioned by an elastic material 42 that maintains its elasticity at low temperatures and that deforms to accommodate agents that might damage the exposed surface, then recovers after the damaging agent passes. Suitable elastic materials for this purpose include low temperature silicon rubbers, expanded polyethylene foams, and closed-cell, high resilience polyurethane foams.

FIG. 8 also schematically shows electrical connections from the laser diode/photodiode package 18, a detector 19, and a thermistor 22, to a cable connector 43, which cable connector connects these ice accumulation monitor components to an external cable 44 for communication with the laser diode/photodiode drive control circuit, a readout device for the detector, and a readout device for the thermistor.

In the preferred embodiment the sloping side 26 of the prism is angled so that radiation emitted perpendicular to this side is incident at the exposed surface 14 at an incident angle greater than $\phi_{c,bare}$ but less than $\phi_{c,ice\text{-}covered}$. This orientation of the sloping side facilitates mounting the emitter for effective operation of this ice accumulation monitor. The other sloping side 27 of the prism is angled so that radiation reflected from the bare exposed surface intersects this sloping side perpendicularly. This orientation of the other sloping side facilitates mounting the detector 19 for effective operation.

THE RADIATION DETECTOR SYSTEM

A photodetector 19, comprised of two separate radiation detectors 20 and 21, is positioned within the prism 17, opposite from the emitter 18, and oriented to detect internally reflected radiation. Alternatively, the operation of this ice accumulation monitor is not changed by the use of two, separate, radiation detectors which are not housed in a single unit. In addition, operation of this ice accumulation monitor is not changed by positioning the photodetector on the sloping prism surface 27, or by transmitting the reflected radiation by optical fibers 39 to external photodetectors 40, as shown in FIG. 6.

A bandpass filter 25, with its bandpass wavelength centered near the emitter's dominant wavelength transmits reflected radiation from the emitter, but significantly reduces the amount of ambient radiation reaching the radiation detectors 20 and 21, so that possible nonlinear radiation detectors' responses at very high radiation levels do not occur. The effect of ambient radiation is then eliminated by pulsing the emitter 18 and subtracting detector responses obtained while the emitter is off from responses obtained while the emitter is on.

THE TEMPERATURE SENSOR

Figure 9:
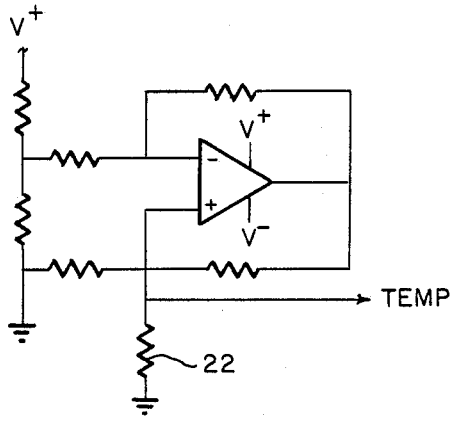
FIG. 9 shows a schematic circuit diagram of a constantcurrent source driving a thermistor temperature sensor.

A temperature sensor 22, preferably located near the exposed surface 14, is used, as discussed hereafter under Ice Accumulation Monitor Operation, in conjunction with responses from the two radiation detectors to distinguish between accumulations of water and accumulations of ice. Temperature sensors usable for this purpose include thermocouples, RTDs, solid state temperature devices, and thermistors. By way of example, FIG. 9 shows a circuit diagram of a constant current source driving a thermistor for use as a temperature sensor. The same type of circuit is also applicable to RTDs. Alternatively, a bridge circuit measuring the resistance of the thermistor or RTD, or other resistance-measuring circuits familiar to those skilled in electronics could be used to determine temperature with a thermistor or an RTD. Standard voltage measuring techniques could be used to determine temperatures from voltage measurements on thermocouples or solid state devices.

As discussed previously in the section The Emitter, the temperature sensor 22 also may be used as a control element for temperature-sensitive emitters that do not have an integral means for maintaining temperature-independent emission intensities. If the temperature sensor is also used as a control element, the temperature sensor is located so that it is near both the emitter and the exposed surface.

ICE ACCUMULATION MONITOR OPERATION

Figure 11:
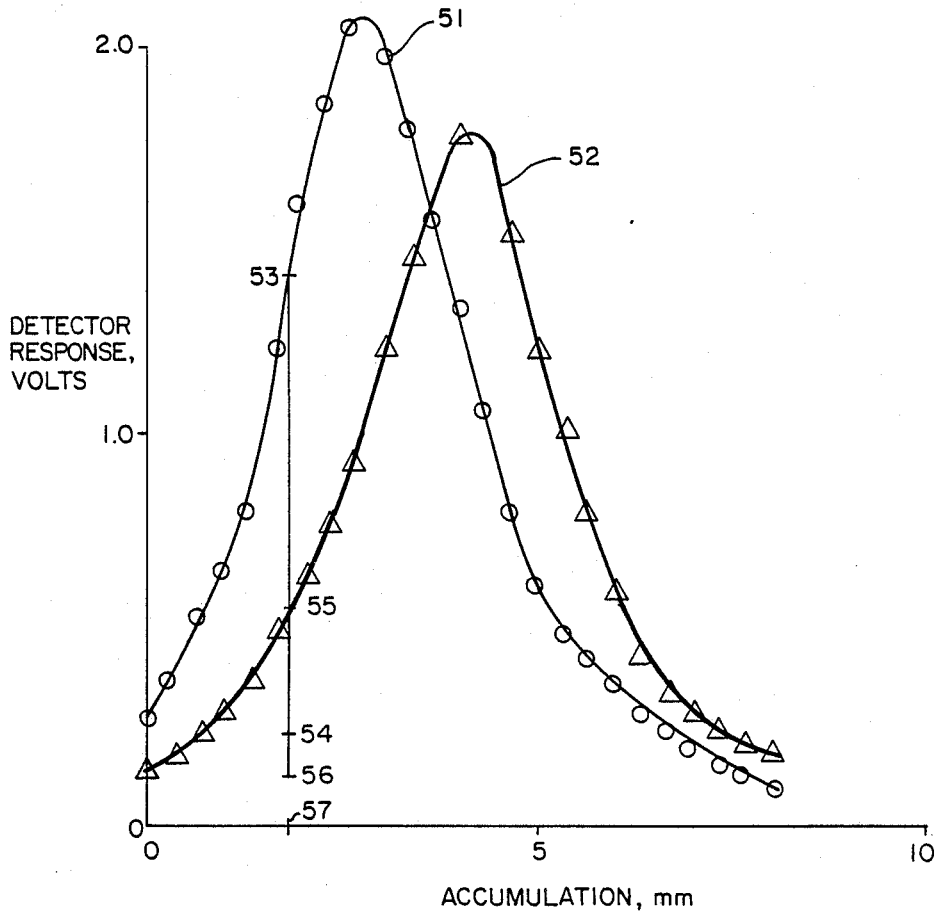
FIG. 11 shows radiation detector responses to accumulations of perfect ice or of water, and shows ranges of responses to an accumulation of flawed ice.

As shown in FIG. 10, when the ice accumulation monitor 15 is operated, a collimated beam of radiation 45 from the emitter 18 intersects the exposed surface 14 and is totally reflected 46 if the exposed surface is bare. For clarity in FIG. 10, beams of radiation are shown as respective rays 45, 46, and 47. The radiation intensities detected by radiation detectors 20 and 21, which are separate sections of photodetector 19, differ because of the different positions of these radiation detectors 20 and 21 relative to the reflected radiation 46. As ice 48 accumulates on the exposed surface 14, part of the emitted radiation is transmitted into the ice 48, and subsequently reflected 47 at the ice-air interface 49, thereby shifting the average effect of the reflected radiation 46 and 47 towards the center of radiation detector 20, and simultaneously shifting the average effect of the reflected radiation 46 and 47 from radiation detector 20 towards radiation detector 21. Continued accumulation eventually causes the average effect of the reflected radiation to shift pass radiation detector 20 so that a maximum occurs in the response-accumulation curve for radiation detector 20. The response of radiation detector 21 is similar, but because of the different relative positions of radiation detectors 20 and 21, the maximum for radiation detector 21 occurs at a greater accumulation than the maximum for radiation detector 20. In FIG. 11, the curve 51 shows a typical response-accumulation curve for radiation detector 20, and the curve 52 shows a typical response-accumulation curve for radiation detector 21.

Calibrations to obtain response-accumulation curves such as 51 and 52 are performed by calibrating radiation detector responses to known accumulations of water. This is possible because the index of refraction of water is 1.33 at the dominant wavelength emitted by the preferred emitter, and this index of refraction is practically the same as the index of refraction of ice, 1.31, at this wavelength.

Design selections, including the placement of the emitter 18, the placement of the radiation detectors 20 and 21, and the intensity of the emitted radiation, affect the shapes and locations of the calibration curves with respect to the response-accumulation coordinates, so with different design selections, different calibration curves will be obtained. However, regardless of the shapes and locations of the calibration curves, once the calibration curves have been obtained, interpretation, as described hereafter, of radiation detector responses in terms of the calibration curves serves to determine the amount of ice accumulated.

If the interface between ice and air 49 is uneven, such as might be caused by surface ice needles formed during freezing or by surface damage of the ice caused by traffic, or if the ice has internal defects such as fracture cracks caused by traffic, the effect of the reflected radiation 47 will be diffused and oriented differently from the effect of reflected radiation transmitted through perfect ice with the ice-air interface parallel to the exposed surface 14 of the ice accumulation monitor 15. Therefore, for any particular accumulation of ice, the response of each radiation detector, 20 or 21, will depend on the severity of surface distortion and the severity of internal defects. Therefore, response-accumulation curves such as 51 and 52 represent responses to accumulations of perfect ice, or, because the index of refraction of water is practically the same as the index of refraction of ice at the dominant wavelength emitted by the preferred emitter, accumulations of water. However, because of the possibility of surface distortion or internal defects, any response in a range between an upper limit determined by curves such as 51 and 52, and a lower limit determined by the response to a severely distorted surface or a severely damaged internal structure, will be possible. Such limits are shown schematically in FIG. 11 at numerals 53 and 54 for upper and lower limits respectively for radiation detector 20, and at numerals 55 and 56 for upper and lower limits respectively for radiation detector 21, for a representative accumulation of ice, designated at numeral 57.

Figure 12:
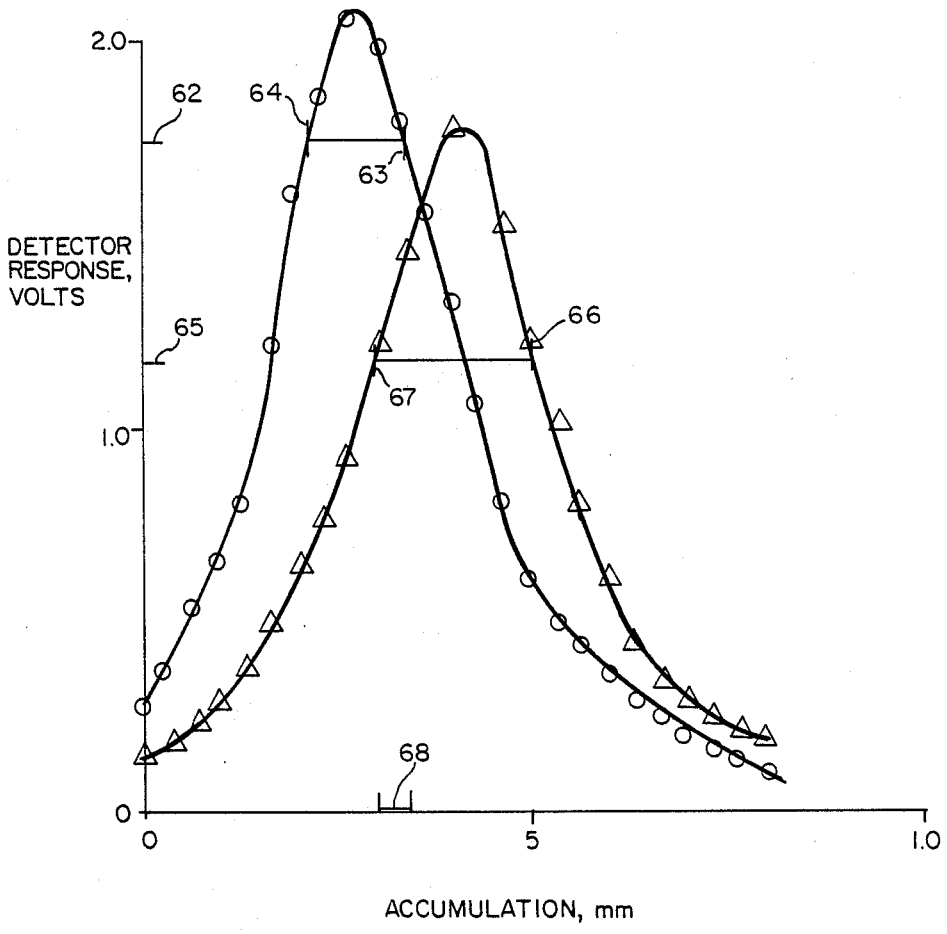
FIG. 12 shows an interpretation of radiation detector responses as bands of accumulations.

Because of the possibility of accumulations of flawed ice, responses of the radiation detectors do not determine unique ice accumulations. Instead, each radiation detector response describes a band of possible ice accumulations, bounded by an upper ice accumulation limit and a lower ice accumulation limit, determined by the calibration curves. For example, for radiation detector 20, the response 62 in FIG. 12 describes a band of ice accumulations bounded by an upper ice accumulation limit 63 and a lower ice accumulation limit 64. Likewise, for radiation detector 21, the response 65 describes a band of ice accumulations bounded by an upper ice accumulation limit 66 and a lower ice accumulation limit 67. For any ice accumulation, responses from radiation detectors 20 and 21 must be compatible because both radiation detectors are responding to the same ice accumulation. This compatibility requirement restricts interpretation of these responses to interpretations for which the ice accumulation bands overlap. For example, the responses 62 for radiation detector 20 and 65 for radiation detector 21 combine to indicate an actual ice accumulation in the range 68 in FIG. 12.

Figure 13:
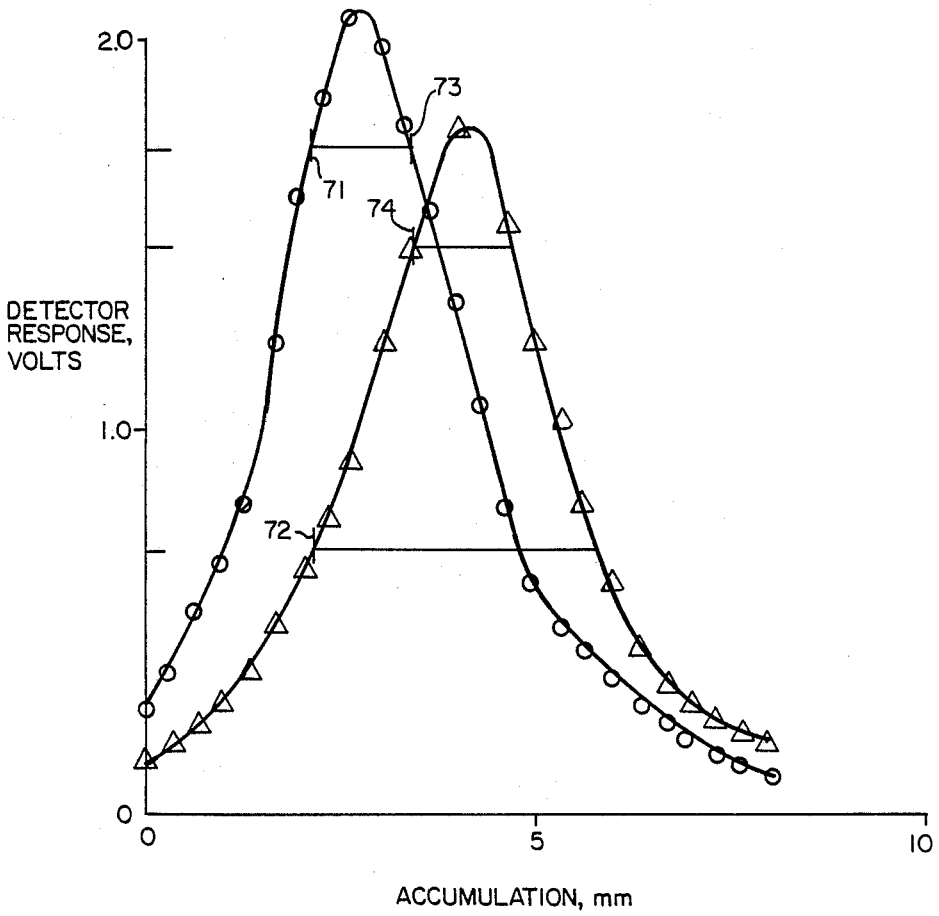
FIG. 13 shows detector responses corresponding to possible accumulations of water.

In addition, responses from the radiation detectors may include a situation in which an ice accumulation limit for one radiation detector is the same as an ice accumulation limit for the other radiation detector. Examples of such a situation are shown by the limits 71 and 72 and the limits 73 and 74 in figure 13. This situation can only occur for an accumulation of water or of perfect ice. Because accumulations of perfect ice are improbable, this situation is normally interpreted as an accumulation of water, unless the temperature sensor indicates a temperature less than the freezing temperature of water. Then, if the temperature is less than the freezing temperature of water, the combined responses of radiation detectors 20 and 21 are interpreted as indicating an accumulation in the range determined by the upper and lower ice accumulation limits.

Salt on a pavement may lower the freezing temperature of the water on the pavement, so that water, instead of ice, may be on the pavement, even when the temperature sensor indicates a temperature below the freezing temperature of water. However, interpretation of the response as ice in this instance is a conservative interpretation because ice will be indicated when the accumulation is actually unfrozen.

Other measurements, such as impedance bridge measurements of the resistance or the capacitance between electrodes which would be mounted flush with the exposed surface, can also be used in conjunction with responses from the radiation detectors to distinguish accumulations of ice from accumulations of water. Therefore, although in this preferred embodiment a temperature sensor is used to assist in distinguishing accumulations of ice from accumulations of water, operation of this ice accumulation monitor is not limited to an embodiment using a temperature sensor for this purpose.

The surface reflectivity of a soil- or mud-covered exposed surface 14 is very low, so that when the exposed surface becomes covered with soil or with mud, nearly all of the emitted radiation is transmitted into the soil or mud, instead of being reflected at the exposed surface 14. Absorption of radiation by soil or mud is very high, so that after being transmitted into the soil or mud on the exposed surface, nearly all of the emitted radiation is absorbed by the soil or mud. Therefore, when the exposed surface is covered by soil or by mud, the amount of radiation reflected to the radiation detectors abruptly becomes negligible, because suddenly nearly all of the emitted radiation becomes absorbed by the soil or mud.

Responses from both radiation detectors will also be negligible for very thick accumulations of ice. This situation is distinguished from soil or mud deposits by a gradual decrease in radiation detectors' responses as ice accumulates, in contrast with the abrupt decrease associated with soil or mud deposits. Therefore the presence of soil or mud on the exposed surface 14, and the consequent need for cleaning the exposed surface, is indicated by abrupt decreases in radiation detector responses, to values which are also not greater than a characteristic threshold value for soil or mud. The threshold value that characterizes a soil- or mud-covered exposed surface is determined by calibration with soil- or mud-covered exposed surfaces.

The preceding discussion about interpreting radiation detectors' responses is incorporated into a series of logical steps to eliminate the effect of ambient radiation on the measurements, to indicate and measure ice accumulations, including accumulations of flawed ice, to signal when ice accumulation has reached a critical thickness, and to distinguish accumulations of water from accumulations of ice. By way of example, such steps are indicated in FIGS. **14*a* and 14*b*. Other sequences of steps could also be used to interpret the radiation detectors' responses, but the sequence shown in FIGS. 14*a* and 14*b*** contains the essential aspects of the interpretation. The interpretation is performed humanly or electronically.

The interpretation requires the response-accumulation calibration curves, 51 and 52, temperature-sensor calibration data, and the soil/mud threshold value, herein identified by MUD. If it is desired to signal an ice accumulation warning for accumulations greater than a critical accumulation, a value for this critical accumulation, herein identified by CRIT, must also be supplied.

If electronic interpretation is to be performed, either a tabular or an analytic representation of the calibration curves is stored in memory prior to starting the interpretation. Values for MUD and CRIT, an arbitrary value, Δ, for comparing present and previous values of corrected radiation detectors' responses, and an arbitrary value, ϵ, for comparing accumulation limits, are also stored in memory. For manual interpretation, graphical or analytic representations of the calibrations will normally be used.

Figure 14A:
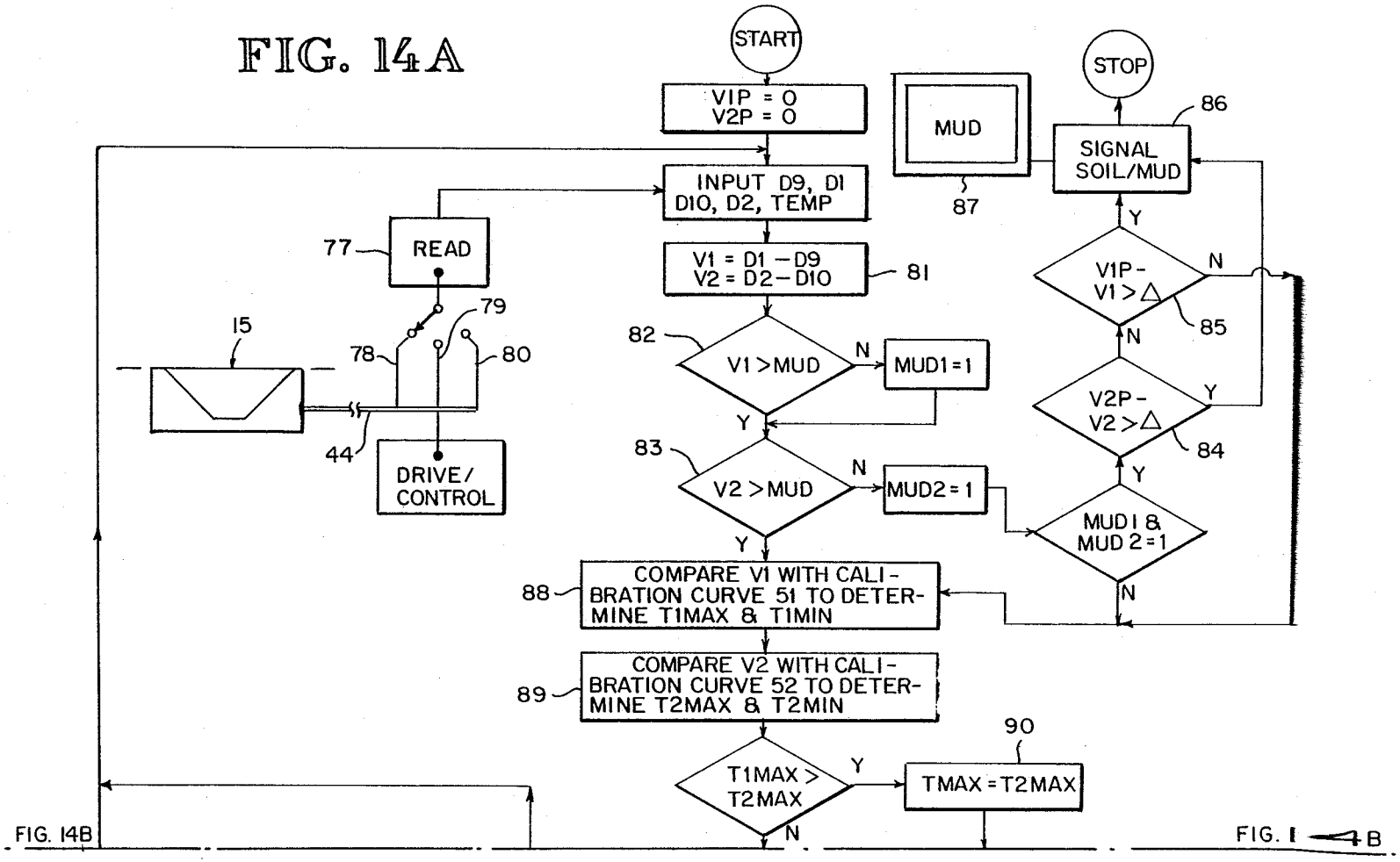
FIGS. 14*a* and 14*b* show logical steps involved in analyzing data from the radiation detectors to eliminate the effect of ambient radiation, to discriminate against accumulations of water, to discriminate against deposits of soil or of mud, to determine ice accumulations, and-/or warn of dangerous ice accumulations.
Figure 14B:
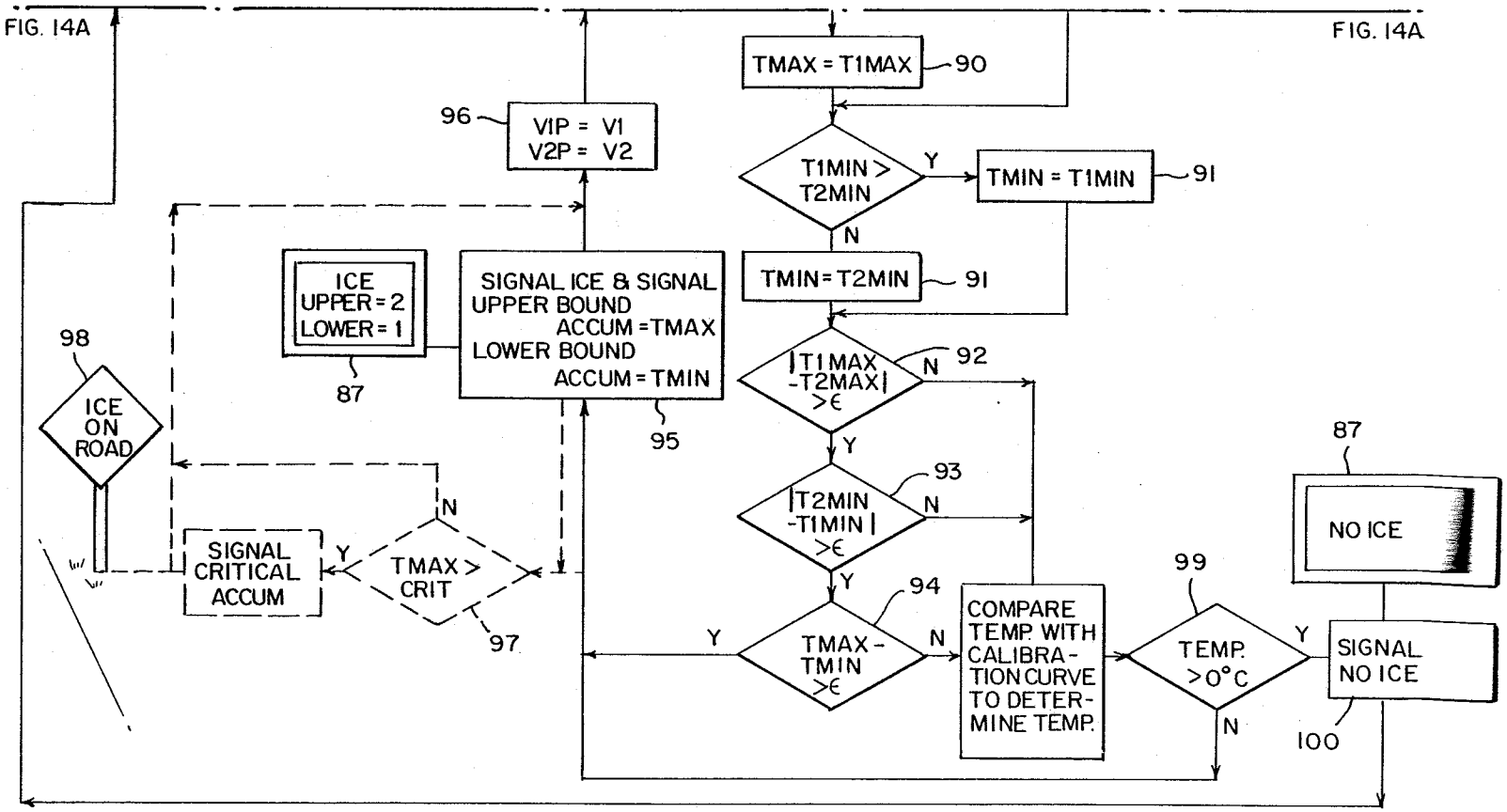

Input data for the interpretation are the response of radiation detector 20 while the emitter is off, herein designated D9, and while the emitter is on, herein designated D1; the response of radiation detector 21 while the emitter is off, herein designated D10, and while the emitter is on, herein designated D2; and the response of the temperature sensor, herein designated TEMP. In FIGS. 14*a* and 14*b* these input data are supplied from a readout device 77, such as a voltmeter, which is switched between the output of radiation detector 20, 78, the output of radiation detector 21, 79, and the output of the temperature sensor 80, to obtain the desired input data. In FIG. 14, responses from the ice accumulation monitor 15 are shown as being transmitted by a data cable 44. In some situations it will be preferable to transmit the ice accumulation monitor responses by telemetry, and this can also be readily accomplished by those skilled in electronic data transmission.

Interpretation begins by assigning the value D1–D9 to V1 and the value D2–D10 to V2, 81. V1 and V2 then represent detector responses that have been corrected to eliminate the effect of ambient radiation. Subsequent interpretation is based on V1 and V2, so these assignments eliminate the effect of ambient radiation from the interpretation.

The interpretation continues by determining if soil or mud is present on the exposed surface. V1 and V2 are each compared with the soil/mud threshold value, 82, 83, and if either V1 or V2 is greater than the threshold value, the interpretation for ice continues. If both V1 and V2 are less than the soil/mud threshold, V1 and V2 are compared with their values V1P and V2P from the previous cycle, 84, 85, to determine if there has been an abrupt decrease in either V1 or V2. If there has been an abrupt decrease in V1 or V2, a deposit of soil or mud is signalled 86. In FIG. 14 a deposit of soil or mud is signalled as a display on a monitor 87. Alternatively a warning light or any other warning alarm could be actuated by the soil/mud signal. After signalling a deposit of soil or mud, the interpretation procedure stops and awaits the cleaning and restarting of the ice accumulation monitor.

If there has not been an abrupt decrease in either V1 or V2, or if either V1 or V2 is greater than the threshold value, the interpretation continues by determining the upper accumulation bound, TMAX, and the lower accumulation bound, TMIN. V1 is compared with the calibration curve 51 for radiation detector 20 to determine the maximum accumulation associated with V1, T1MAX, and the minimum accumulation associated with V1, T1MIN, 88. Also, V2 is compared with the calibration curve 52 for radiation detector 21 to determine the maximum accumulation associated with V2, T2MAX, and the minimum accumulation associated with V2, T2MIN, 89. The upper accumulation bound is then the lesser of T1MAX and T2MAX, 90, and the lower accumulation bound is the greater of T1MIN and T2MIN, 91.

The interpretation then continues by determining whether the accumulation is water or ice. When water accumulates on the exposed surface, the temperature is above freezing, and one set of accumulation bounds for radiation detectors 20 and 21 coincide, such as indicated by the bounds 71 and 72, or the bounds 73 and 74 in FIG. 13. Accumulation bounds coincide if, I, both upper bounds are the same, II, both lower bounds are the same, or III, the upper bound from one curve is the same as the lower bound from the other curve. These possibilities are checked 92, 93, 94, and if, to within a small difference, ϵ, none of the accumulation bounds are the same, the accumulation can not be water. Therefore an accumulation of ice is present, and either:

1. An ice accumulation and the upper and lower accumulation bounds are signalled, 95, and recorded and/or displayed, as desired 87, and the procedure is readied for the next set of data 96; or 2. The upper accumulation bound is compared with the critical accumulation, CRIT, 97, a warning is actuated 98 if the accumulation exceeds CRIT or the warning is not actuated if the accumulation is less than CRIT, and the procedure is readied for the next set of data 96; or 3. These alternatives are combined so that upper and lower accumulation bounds are signalled 95, and recorded and/or displayed, as desired 87, the accumulation is evaluated to determine if it is a critical accumulation 97, a warning is actuated if the accumulation exceeds CRIT 98, and the procedure is readied for the next set of data 96.

In FIGS. 14*a* and 14*b*, the alternative of testing for a critical accumulation is indicated by dashed lines, and the occurrence of a critical accumulation is shown as actuating an active highway warning sign 98. Instead of actuating a highway warning sign, warning lights, horns, or other alarms, could also be actuated, to suit the needs of the particular application.

If any of the accumulation bounds do coincide, the temperature is checked 99 and if the temperature is greater than zero degrees Celsius, water is signalled 100, and an appropriate message is displayed on a monitor 87. If the temperature is less than zero degrees Celsius, an accumulation of ice is present, and either:

1. An ice accumulation and the upper and lower accumulation bounds are signalled 95, and recorded and/or displayed, as desired 87, and the procedure is readied for the next set of data 96; or 2. The upper accumulation bound is compared with the critical accumulation, CRIT, 97, a warning is actuated 98 if the accumulation exceeds CRIT or the warning is not actuated if the accumulation is less than CRIT, and the procedure is readied for the next set of data 96; or 3. These alternatives are combined so that upper and lower accumulation bounds are signalled 95, and recorded and/or displayed, as desired 87, the accumulation is evaluated to determine if it is a critical accumulation 97, a warning is actuated if the accumulation exceeds CRIT 98, and the procedure is readied for the next set of data 96.

In addition, instantaneous accumulation rates, or average accumulation rates for any desired time interval, can be readily determined by storing measured accumulation limits, taking differences of accumulations, and dividing by the appropriate time interval.

By using this ice accumulation monitor 15, many persons will be reliably informed of when, and how much, ice is being formed, generally in places and on surfaces where it is not wanted, and, if desired, persons can be warned when critical accumulation limits are exceeded, informed of accumulation rates and warned when accumulation rates are dangerous. Then appropriate measures can be taken to remove the ice or to mitigate against its consequences.

APPLICATION TO SUBSTANCES OTHER THAN ICE/WATER

In addition, total reflection at the bare exposed surface, with partial transmission at a covered exposed surface and total reflection at the subsequent air interface, and calibration curves similar to the responses 51 and 52 in FIG. 11, will also be obtained for accumulations of other transparent substances, such as ethyl alcohol or ethyl ether, which have indexes of refraction less than the index of refraction of the prism. Therefore, application of this accumulation monitor is not restricted to measuring accumulations of ice or of water, but with calibrations for these other substances, this accumulation monitor will also measure accumulations of these other substances and distinguish accumulations of the solid form from accumulations of the liquid.

I claim:

1. An ice accumulation monitor for detecting the formation of ice on a surface and measuring the amount of ice accumulated, comprising:

(a) a prism that is transparent to radiation emitted by an emitter and with one surface of the prism exposed to ice accumulation and this surface positioned in the same plane as the surface on which ice accumulation is to be measured;

(b) an emitter of pulsed electromagnetic radiation with means for maintaining the emission intensity independent of temperature, which emitter is oriented so that at the exposed prism surface the emitted radiation is totally reflected within the prism when the exposed prism surface is bare, but at the exposed prism surface the emitted radiation is only partially reflected within the prism when the exposed prism surface is covered with ice and the balance of the emitted radiation is transmitted into the ice layer and reflected at the subsequent ice-air interface;

(c) two radiation detectors located to detect radiation reflected within the prism with one radiation detector located closer to the exposed surface than the other radiation detector; and (d) a temperature sensor located in the transparent prism near the exposed surface, whereby upper and lower bounds of ice accumulation are measured by comparing outputs from each radiation detector with a calibration curve for that radiation detector.

2. An ice accumulation monitor, as claimed in claim 1, having a bandpass filter located with respect to the two radiation detectors and the exposed prism surface so that the amount of ambient radiation reaching the detectors is reduced, which bandpass filter has its bandpass wavelength centered near the dominant wavelength of the emitter.

3. An ice accumulation monitor, as claimed in claim 1, having the exposed surface made of a hard layer that is transparent to the radiation from the emitter.

4. An ice accumulation monitor, as claimed in claim 1, having the prism cushioned by an elastic material so that potential damage to the exposed prism surface is reduced.

5. An ice accumulation monitor, as claimed in claim 1, with the emitted radiation transmitted to the prism and directed at the exposed prism surface by an optical fiber so that at the exposed prism surface the emitted radiation is totally reflected within the prism when the exposed prism surface is bare, but at the exposed prism surface the emitted radiation is only partially reflected within the prism when the exposed prism surface is covered with ice and the balance of the emitted radiation is transmitted into the ice layer and reflected at the subsequent ice-air interface.

6. An ice accumulation monitor, as claimed in claim 1, with the end of an optical fiber at each radiation detector location and the reflected radiation transmitted by the optical fibers to the radiation detectors which are removed to locations exterior to the prism.

7. An ice accumulation monitor, as claimed in claim 2, having the exposed surface made of a hard layer that is transparent to the radiation from the emitter.

8. An ice accumulation monitor, as claimed in claim 2, having the prism cushioned by an elastic material so that potential damage to the exposed prism surface is reduced.

9. An ice accumulation monitor, as claimed in claim 2, with the emitted radiation transmitted to the prism and directed at the exposed prism surface by an optical fiber so that at the exposed prism surface the emitted radiation is totally reflected within the prism when the exposed prism surface is bare, but at the exposed prism surface the emitted radiation is only partially reflected within the prism when the exposed prism surface is covered with ice and the balance of the emitted radiation is transmitted into the ice layer and reflected at the subsequent ice-air interface.

10. An ice accumulation monitor, as claimed in claim 2, with the end of an optical fiber at each radiation detector location and the reflected radiation transmitted by the optical fibers to the radiation detectors which are removed to locations exterior to the prism.

11. An ice accumulation monitor, as claimed in claim 3, having the prism cushioned by an elastic material so that potential damage to the exposed prism surface is reduced.

12. An ice accumulation monitor, as claimed in claim 3, with the emitted radiation transmitted to the prism and directed at the exposed prism surface by an optical fiber so that at the exposed prism surface the emitted radiation is totally reflected within the prism when the exposed prism surface is bare, but at the exposed prism surface the emitted radiation is only partially reflected within the prism when the exposed prism surface is covered with ice and the balance of the emitted radiation is transmitted into the ice layer and reflected at the subsequent ice-air interface.

13. An ice accumulation monitor, as claimed in claim 3, with the end of an optical fiber at each radiation detector location and the reflected radiation transmitted by the optical fibers to the radiation detectors which are removed to locations exterior to the prism.

14. An ice accumulation monitor, as claimed in claim 4, with the emitted radiation transmitted to the prism and directed at the exposed prism surface by an optical fiber so that at the exposed prism surface the emitted radiation is totally reflected within the prism when the exposed prism surface is bare, but at the exposed prism surface the emitted radiation is only partially reflected within the prism when the exposed prism surface is covered with ice and the balance of the emitted radiation is transmitted into the ice layer and reflected at the subsequent ice-air interface.

15. An ice accumulation monitor, as claimed in claim 4, with the end of an optical fiber at each radiation detector location and the reflected radiation transmitted by the optical fibers to the radiation detectors which are removed to locations exterior to the prism.

16. An ice accumulation monitor, as claimed in claim 5, with the end of an optical fiber at each radiation detector location and the reflected radiation transmitted by the optical fibers to the radiation detectors which are removed to locations exterior to the prism.

17. An ice accumulation monitor, as claimed in claim 7, having the prism cushioned by an elastic material so that potential damage to the exposed prism surface is reduced.

18. An ice accumulation monitor, as claimed in claim 7, with the emitted radiation transmitted to the prism and directed at the exposed prism surface by an optical fiber so that at the exposed prism surface the emitted radiation is totally reflected within the prism when the exposed prism surface is bare, but at the exposed prism surface the emitted radiation is only partially reflected within the prism when the exposed prism surface is covered with ice and the balance of the emitted radiation is transmitted into the ice layer and reflected at the subsequent ice-air interface.

19. An ice accumulation monitor, as claimed in claim 7, with the end of an optical fiber at each radiation detector location and the reflected radiation transmitted by the optical fibers to the radiation detectors which are removed to locations exterior to the prism.

20. An ice accumulation monitor, as claimed in claim 8, with the emitted radiation transmitted to the prism and directed at the exposed prism surface by an optical fiber so that at the exposed prism surface the emitted radiation is totally reflected within the prism when the exposed prism surface is bare, but at the exposed prism surface the emitted radiation is only partially reflected within the prism when the exposed prism surface is covered with ice and the balance of the emitted radiation is transmitted into the ice layer and reflected at the subsequent ice-air interface.

21. An ice accumulation monitor, as claimed in claim 8, with the end of an optical fiber at each radiation detector location and the reflected radiation transmitted by the optical fibers to the radiation detectors which are removed to locations exterior to the prism.

22. An ice accumulation monitor, as claimed in claim 9, with the end of an optical fiber at each radiation detector location and the reflected radiation transmitted by the optical fibers to the radiation detectors which are removed to locations exterior to the prism.

23. An ice accumulation monitor, as claimed in claim 11, with the emitted radiation transmitted to the prism and directed at the exposed prism surface by an optical fiber so that at the exposed prism surface the emitted radiation is totally reflected within the prism when the exposed prism surface is bare, but at the exposed prism surface the emitted radiation is only partially reflected within the prism when the exposed prism surface is covered with ice and the balance of the emitted radiation is transmitted into the ice layer and reflected at the subsequent ice-air interface.

24. An ice accumulation monitor, as claimed in claim 11, with the end of an optical fiber at each radiation detector location and the reflected radiation transmitted by the optical fibers to the radiation detectors which are removed to locations exterior to the prism.

25. An ice accumulation monitor, as claimed in claim 12, with the end of an optical fiber at each radiation detector location and the reflected radiation transmitted by the optical fibers to the radiation detectors which are removed to locations exterior to the prism.

26. An ice accumulation monitor, as claimed in claim 14, with the end of an optical fiber at each radiation detector location and the reflected radiation transmitted by the optical fibers to the radiation detectors which are removed to locations exterior to the prism.

27. An ice accumulation monitor, as claimed in claim 1, wherein water accumulation is distinguished from ice accumulation by nearly equal accumulation bounds combined with a temperature greater than zero degrees Celsius.

28. An ice accumulation monitor, as claimed in claim 1, wherein the response of each radiation detector is compared with a threshold radiation detector response that characterizes soil or mud accumulation, and each radiation detector response is compared with previous radiation detector responses, to distinguish accumulations of soil or mud from accumulations of ice.

29. An ice accumulation monitor, as claimed in claim 1, wherein the effect of ambient radiation is eliminated from the measurements by subtracting the response of each radiation detector when the emitter is in the off portion of its cycle from the radiation detector response when the emitter is in the on portion of its cycle.

30. An accumulation monitor as claimed in claim 1 whereby upper and lower accumulation bounds of a substance other than ice are measured by comparing outputs from each radiation detector with a calibration curve for that substance and that radiation detector.

* * * * *